US012571069B2

(12) United States Patent
Kaussen et al.

(10) Patent No.: US 12,571,069 B2
(45) Date of Patent: Mar. 10, 2026

(54) METHOD FOR THE RECOVERY OF METALS FROM ELECTRONIC WASTE

(71) Applicant: SMS group GmbH, Düsseldorf (DE)

(72) Inventors: Frank Marlin Kaussen, Aachen (DE); Rolf Degel, Ratingen (DE); Timm Lux, Meerbusch (DE)

(73) Assignee: SMS group GmbH, Düsseldorf (DE)

( * ) Notice: Subject to any disclaimer, the term of this patent is extended or adjusted under 35 U.S.C. 154(b) by 442 days.

(21) Appl. No.: 18/015,606

(22) PCT Filed: Jul. 2, 2021

(86) PCT No.: PCT/EP2021/068313
§ 371 (c)(1),
(2) Date: Jan. 11, 2023

(87) PCT Pub. No.: WO2022/012968
PCT Pub. Date: Jan. 20, 2022

(65) Prior Publication Data

US 2023/0250509 A1 Aug. 10, 2023

(30) Foreign Application Priority Data

Jul. 13, 2020 (DE) ..... 10 2020 208 739.3

(51) Int. Cl.

| | |
|---|---|
| ***C22B 15/00*** | (2006.01) |
| ***C22B 7/00*** | (2006.01) |
| ***C22B 9/05*** | (2006.01) |
| ***C22B 9/10*** | (2006.01) |

(52) U.S. Cl.
CPC ..... *C22B 15/006* (2013.01); *C22B 7/005* (2013.01); *C22B 9/05* (2013.01); *C22B 9/10* (2013.01); *C22B 15/0054* (2013.01); *C22B 15/0056* (2013.01)

(58) Field of Classification Search
CPC . C22B 1/005; C22B 15/0054; C22B 15/0056; C22B 15/006; C22B 7/005; C22B 7/04; C22B 9/05; C22B 9/10; C22B 5/12; C22B 9/16
See application file for complete search history.

(56) References Cited

U.S. PATENT DOCUMENTS

| | | | | |
|---|---|---|---|---|
| 3,664,828 | A | 5/1972 | Worner | |
| 3,682,623 | A * | 8/1972 | Dierckx et al. | C22B 15/006 75/640 |
| 4,705,562 | A | 11/1987 | Hedlund | |
| 6,524,737 | B1 * | 2/2003 | Tanii | H01M 10/54 429/49 |
| 2005/0284261 | A1 | 12/2005 | Sandberg | |
| 2014/0069234 | A1 * | 3/2014 | Takahashi | C22B 1/02 75/414 |
| 2018/0274058 | A1 | 9/2018 | Filzwieser et al. | |
| 2020/0078796 | A1 * | 3/2020 | Kochhar | C22B 26/12 |
| 2021/0071282 | A1 | 3/2021 | Coletti et al. | |

FOREIGN PATENT DOCUMENTS

| | | | |
|---|---|---|---|
| CA | 3085071 | A1 | 6/2019 |
| CN | 108224433 | A | 6/2018 |
| CN | 208011721 | U | 10/2018 |
| DE | 602005002305 | | 10/2007 |
| EP | 1609877 | A1 | 12/2005 |
| GB | 1304079 | * | 1/1973 |
| JP | H0643621 | A | 2/1994 |
| JP | H10147821 | A | 6/1998 |
| JP | 2000192164 | A | 7/2000 |
| JP | 2003193147 | B | 12/2005 |
| WO | 8605211 | A1 | 9/1986 |
| WO | 2017001306 | A1 | 1/2017 |
| WO | 2019115540 | A1 | 6/2019 |

OTHER PUBLICATIONS

Alvear Flores, Gerardo RF, Stanko Nikolic, and Phillip J. Mackey. "ISASMELT™ for the recycling of E-scrap and copper in the US case study example of a new compact recycling plant." Jom 66, No. 5 (2014): 823-832.

* cited by examiner

*Primary Examiner* — Nicholas A Wang
(74) *Attorney, Agent, or Firm* — Smartpat PLC

(57) ABSTRACT

A method for obtaining metals of the 8th to 14th groups, in particular raw copper, comprises the following steps: i) providing and melting down a mixed feed comprising electronic waste in a smelting reactor, so that a first melt with a first metallic phase and a first slag phase is formed; ii) separating out the first slag phase from the smelting reactor; iii) refining the remaining first metallic phase by means of an oxygen-containing gas, possibly with the addition of copper-containing residual materials, so that a second, copper-enriched slag phase is formed; iv) possibly separating off the second slag phase and repeating the step; v) separating off the refined first metallic phase from the smelting reactor; and vi) adding a further mixed feed comprising electronic waste to the remaining second, copper-enriched slag phase and repeating process steps i) to vi).

16 Claims, No Drawings

METHOD FOR THE RECOVERY OF METALS FROM ELECTRONIC WASTE

TECHNICAL FIELD

The present disclosure relates to a method for obtaining metals of the 8th to 14th groups from electronic waste.

BACKGROUND

A method for recycling copper-containing residual materials is generally known. Specifically, this method provides for such residual materials to be introduced into a cylindrical furnace vessel from above and to be exposed inside the furnace vessel with oxygen-enriched air introduced into the furnace from above by means of a top lance. In this manner, the introduced residual materials are melted down and a metal phase with a floating slag phase is formed in the furnace. Such heterogeneous phases are both periodically tapped together from the vessel. Separation of the metal phase, which has a high copper fraction, from the slag phase only takes place outside the cylindrical furnace vessel.

Furthermore, Chinese patent application CN 108224433 A discloses a method for recycling electronic waste for the purpose of recovery, in particular copper. The method provides that the electronic waste as feed material is initially weighed, mixed and crushed before it is then fed into a preheated rotary furnace. There, the electronic waste is exposed to oxygen and gaseous fuels. The feed material then melts into a metal phase and a slag phase. After blowing treatment with oxygen, the metal phase and the slag phase are tapped separately.

The European patent application EP 1 609 877 A1 discloses a method for the processing in batches of metal-containing residual materials, such as in particular electronic waste, in a rotating reactor. The feed material, i.e. in particular the electronic waste, consists substantially of fractions of such size as to permit continuous loading during operation. In the reactor, the material is melted down to produce a processed product that is substantially free of any organic matter because the original organic fraction of the feed material burns off during the melting down.

SUMMARY

The present disclosure is based on the object of providing a method for recovering metals of groups 8 to 14 that is improved compared to the prior art, in particular providing a method with which at least one of the metals of groups 8 to 14 is quantitatively obtained from the electronic waste used.

In accordance with the invention, the object is achieved by a method as claimed.

Further advantageous embodiments are indicated in the dependent formulated claims. The features listed individually in the dependent formulated claims can be combined with one another in a technologically useful manner and can define further embodiments of the invention. In addition, the features indicated in the claims are further specified and explained in the description, wherein further preferred embodiments of the invention are illustrated.

The method for obtaining metals of the 8th to 14th groups, preferably of the groups 8 to 11 and 14, and in particular raw copper, comprises the steps of:

i) providing and melting down a mixed feed comprising electronic waste in a smelting reactor, so that a first melt with a first metallic phase and a first slag phase is formed, ii) separating out the first slag phase from the smelting reactor, iii) refining the remaining first metallic phase by means of an oxygen-containing gas, possibly with the addition of copper-containing residual materials, so that a second, copper-enriched slag phase is formed, iv) possibly separating off the second slag phase and repeating step iii), v) separating off the refined first metallic phase from the smelting reactor; and vi) adding a further mixed feed comprising electronic waste to the remaining second, copper-enriched slag phase and repeating process steps i) to vi).

Surprisingly, it has been shown that the raw copper present in the second copper-enriched slag phase, which has accumulated as copper oxide in the second slag phase during refining/conversion, can be transferred to the then new first metallic phase during the melting down of the next batch or the further mixed feed, as the case may be, as a result of the prevailing reducing conditions in the smelting reactor and recovered directly from this. Thus, the continuous continuation of the method yields only slag phases that are largely depleted of copper. As a result of this in-situ recovery of the oxidized copper, the metallic phase obtained thus has an increased raw copper content. In addition, it has been surprisingly shown that the entire process has an improved energy balance due to the further use of the still liquid residual slag or the second copper-enriched slag phase, as the case may be, and that the chemically bound oxygen of the copper oxide of the residual slag assists the combustion reaction with each additional mixed feed.

In order to obtain a slag that is as molten as possible and thus not too viscous, the entire process is operated at a temperature of at least 1150° C., more preferably at a temperature of at least 1200° C., even more preferably at a temperature of at least 1225° C., and most preferably at a temperature of 1250° C. However, for reasons of plant engineering, the temperature of the process must not exceed a maximum temperature. Therefore, the maximum temperature in the process is 1400° C., preferably a maximum temperature of 1375° C., more preferably a maximum temperature of 1350° C., and most preferably a maximum temperature of 1325° C.

The method is intended for the pyrometallurgical processing of electronic waste. According to this, in principle, up to 100 wt % of electronic waste can be used in the mixed feed.

Within the meaning of the present disclosure, the term "electronic waste" is understood to mean, firstly, waste electronic equipment as defined in accordance with EU Directive 2002/96/EC. Categories of equipment covered by this Directive concern whole and/or (partially) disassembled components from the range comprising large household appliances; small household appliances; IT and telecommunication equipment; consumer equipment; lighting equipment; electrical and electronic tools (with the exception of large-scale industrial tools); electrical toys and sports and leisure equipment; medical devices (with the exception of all implanted and infected products); monitoring and control instruments; and automatic dispensers. With regard to the individual products that fall into the corresponding category of equipment, reference is made to Annex D3 of the Directive.

Furthermore, the term "electronic waste" also includes residues and/or byproducts arising from electronic waste processing.

The electronic waste may be present within the mixed feed in the form of individual fractions and/or in the form of mixtures of the respective components.

If necessary, copper-containing residual materials can be added to the process in step iii) for cooling purposes. Within the meaning of the present disclosure, the term "copper-containing residual materials" is understood to mean any copper-containing residual materials comprising a significant mass fraction of copper and not covered by the specified EU Directive 2002/96/EC, such as metallic copper waste, copper gutters and/or dried copper-containing sludges and/or dusts from copper and/or copper alloy production and/or processing.

Electronic waste substantially comprises an organic content in the form of hydrocarbon-containing components, such as plastics in particular, and metallic components, such as in particular the elements selected from the series comprising iron, ruthenium, osmium, cobalt, rhodium, iridium, nickel, palladium, platinum, copper, silver, gold, zinc, cadmium, mercury, aluminum, gallium, indium, lead and/or tin, and optionally antimony, titanium and/or yttrium.

However, the organic content in the form of the hydrocarbon-containing components must not be too small in the mixed feed, otherwise there will not be a sufficient combustion reaction. As such, the fraction of the hydrocarbon-containing components in the electronic waste or in the mixed feed, as the case may be, is preferably at least 5.0 wt %, more preferably at least 10.0 wt %. With regard to the maximum content, the electronic waste or the mixed feed, as the case may be, is limited and is therefore preferably a maximum of 80.0 wt %, more preferably a maximum of 70.0 wt %, even more preferably a maximum of 60.0 wt % and most preferably a maximum of 50.0 wt %.

If the available electronic waste does not have the desired fraction of organic content and thus does not have the required calorific value, a selective amount of conventional fuels can be added to the mixed feed. Conventional fuels comprise, for example, coal, coke, and combustible gases such as natural gas, propane, hydrogen, or other gases known to the skilled person.

The feeding of the solid and/or gaseous fuels can be accomplished by a feeding device, such as a lance extending into the smelting reactor, or one or more nozzles.

The melting down of the mixed feed in accordance with step i) is usually carried out in the presence of atmospheric oxygen. The addition of atmospheric oxygen, possibly in the form of oxygen-enriched air or in the form of oxygen-containing gas, which is continuously introduced into the smelting reactor during the smelting process, results in the combustion of the hydrocarbons from the mixed feed supplied. Thereby, combustion and thus heat generation can be specifically controlled by the amount of oxygen added. In principle, the higher the fraction of hydrocarbons in the mixed feed, the lower the oxygen content of the combustion air added can be. However, due to the air composition, this is always at least 20.5% by volume.

With a low fraction of hydrocarbons in the mixed feed, the melting down process can be carried out at an oxygen content in the combustion air of up to 100% by volume.

Advantageously, step i) of the method is assisted by the selective injection of an oxygen-containing gas in order to always form a reducing atmosphere at the surface of the melt. As such, the reaction is adjusted in such a manner that complete combustion of the hydrocarbons to $CO_2$ and $H_2O$ does not occur, but contents of CO, $H_2$ are also formed in the process gas.

When the mixed feed is melted down, a metallic phase is formed, which contains the raw copper along with other heavy metals, in particular lead (Pb), tin (Sn), zinc (Zn), nickel (Ni) and the precious metals gold (Au) and silver (Ag). The mineral components of the electronic waste of the mixed feed together with oxides of the oxygen affinity elements, such as in particular lead (Pb), tin (Sn), nickel (Ni), iron (Fe), silicon (Si), titanium (Ti), sodium (Na), calcium (Ca), aluminum (Al), magnesium (Mg), etc., form the lighter slag phase.

The completeness of combustion at the melt surface simultaneously controls the heat input at the melt surface and the degree of oxidation of the accompanying elements. In this manner, the selective oxidation of the undesirable components, such as elemental aluminum or silicon is oxidized and selectively transferred to the slag phase. As such, the metallic phase obtained is characterized by a residual content of both elements of <0.1 wt % each.

If an excessive amount of oxygen has been added to the process in step i), the first slag phase can advantageously be reduced by means of a reducing agent. This purifies and post-reduces the first slag phase so that any heavy metal oxides present, such as SnO, $Cu_2O$, NiO, PbO and/or ZnO, can be converted into their metallic form and thus into the metallic phase.

The smelting reactor is preferably a metallurgical vessel, such as a tiltable rotary converter, in particular a so-called top-blown rotary converter (TBRC), or a tiltable stand-alone converter. In an advantageous design variant, the metallurgical vessel comprises a first tap opening for tapping the metallic phase and/or a second tap opening for tapping the slag phase. Thereby, the tapping opening for tapping the metallic phase is advantageously arranged in the bottom and/or in the side wall of the corresponding smelting reactor, so that it can be removed via this.

In an advantageous design variant, the mixed feed, in particular each of the mixed feeds comprises the electronic waste in an amount of at least 10.0 wt %, more preferably in an amount of at least 15.0 wt %, even more preferably in an amount of at least 20.0 wt %, further preferably in an amount of at least 25.0 wt %, further preferably in an amount of at least 30.0 wt %, further preferably in an amount of at least 35.0 wt %, further preferably in an amount of at least 40.0 wt %, further preferably in an amount of at least 45.0 wt %, further preferably in an amount of at least 50.0 wt %, further preferably in an amount of at least 55.0 wt %, further preferably in an amount of at least 60.0 wt %, further preferably in an amount of at least 65.0 wt %, further preferably in an amount of at least 70.0 wt %, further preferably in an amount of at least 80.0 wt %, further preferably in an amount of at least 90.0 wt %, and most preferably in an amount of at least 95.0 wt %, based on the total mixed feed.

In a further advantageous design variant, the mixed feed comprises a slag-forming agent and/or this is added to the process in steps i) and/or iii). In this connection, it is particularly preferred that the mixed feed comprises the slag-forming agent in an amount of at least ⅛ of the mass fraction of the electronic waste present in the mixed feed, more preferably in an amount of at least ⅕, even more preferably in an amount of at least ⅓. The slag-forming agent is advantageously selected from the group consisting of iron, calcium oxides, iron oxides, silicon oxides, magnesium oxides, sodium oxides, calcium carbonates, magnesium carbonates, sodium carbonates and/or calcium hydroxides, iron hydroxides, magnesium hydroxides, sodium hydroxides and/or mixtures thereof.

Advantageously, the electronic waste or the mixed feed, as the case may be, comprises an aluminum content (elemental) of at least 0.1 wt %, more preferably an aluminum content of at least 0.5 wt %, even more preferably an aluminum content of at least 1.0 wt %, and most preferably an aluminum content of at least 3.0 wt %. With regard to the maximum content of elemental aluminum, the electronic waste or the mixed feed, as the case may be, is limited, since an excessively high aluminum content has a detrimental effect on the viscosity and thus the flowability of the slag phase as well as on the separation behavior between the metallic phase and the slag phase. Therefore, the electronic waste or mixed feed, as the case may be, preferably contains at most 20.0 wt % aluminum, more preferably at most 15.0 wt % aluminum, even more preferably at most 11.0 wt % aluminum, and most preferably at most 8.0 wt % aluminum.

Insofar as electronic waste or the mixed feed comprises an aluminum content of less than 5.0 wt %, it is advantageously provided that slag-forming agents are added to the process, preferably in step i), in an amount of up to 25.0 wt %, based on the amount of electronic waste contained in the mixed feed. Insofar as the electronic waste or the mixed feed, as the case may be, comprises a higher aluminum content, in particular one with an aluminum content of 5.0-10.0 wt %, the amount of slag-forming agents added to the process, preferably in step i), is advantageously 10.0-45.0 wt %. If the electronic waste or the mixed feed, as the case may be, comprises an even higher aluminum content, in particular one with an aluminum content of >10.0 wt %, the amount of slag-forming agents added to the process, preferably in step i), is advantageously 20.0-60.0 wt %.

Advantageously, the mixed feed is configured such that its viscosity in the molten, i.e. liquid, aggregate state is in the range from 0.01 to 10.0 Pa*s, more preferably in the range from 0.05 to 10.0 Pa*s, even more preferably in the range from 0.1 to 10.0 Pa*s, and most preferably in the range from 0.1 to 5.0 Pa*s.

The charging and thus the energy input into the smelting reactor can be uneven due to different particle sizes and, in particular, due to excessively large particle sizes, so that undesirable conditions are formed during the smelting process. As such, the electronic waste is provided in crushed form, wherein, due to the shredding process, smaller unavoidable fractions, such as dusts and/or flour-like fractions, are always included.

Advantageously, the electronic waste is crushed to a particle size smaller than 20.0 inches, more preferably to a particle size smaller than 15.0 inches, even more preferably to a particle size smaller than 12.0 inches, further preferably to a particle size smaller than 10.0 inches, further preferably to a particle size smaller than 5.0 inches, and most preferably to a particle size smaller than 2.0 inches. However, the particle size should not be less than 0.1 inch, preferably a particle size of 0.5 inch, more preferably a particle size of 1.5 inch. In this connection, it has proved particularly advantageous if the electronic waste is also provided in the form of pressed articles in accordance with step i). Thereby, on the one hand, the reactor space of the smelting reactor is optimally utilized and, on the other hand, the smelting process is accelerated.

Within the meaning of the present disclosure the term "pressed article" is understood to mean a piece pressed and formed from crushed electronic waste. In this respect, the pressed articles may form the shape of briquettes, pellets and/or agglomerated packets.

The invention and the technical environment are explained in more detail below by means of an example. It should be noted that the invention is not intended to be limited by the explained exemplary embodiment. In particular, unless explicitly stated otherwise, it is also possible to extract partial aspects of the facts explained and combine them with other components and findings from the present description.

DETAILED DESCRIPTION/EXAMPLE

In principle, the method is provided for obtaining non-ferrous metals of the 8th to 14th group of the periodic table. In particular, in the present design variant, it is provided for the obtaining of raw copper from electronic waste, also obtaining significant fractions of silver (Ag), gold (Au), platinum (Pt) and palladium (Pd).

In a first process step, a mixed feed comprising 68 wt % of electronic waste and residual slag-forming agents in the form of 25 wt % of an iron oxide additive and 7 wt % of an $SiO_2$ additive was initially prepared.

The electronic waste provided consisted of pressed articles with a size of 1.5 to 2.5 inches, which were pressed from crushed electronic waste. The composition of the electronic waste was 18 wt % Cu; 25 wt % hydrocarbons; 7 wt % Al, 12 wt % Si, 7 wt % heavy metals from the series comprising Pb, Sn, Ni, Cr along with Zn, 3 wt % Ca, 2 wt % halogens and 5 wt % Fe, along with residues of chemically bound oxygen along with unavoidable impurities.

The mixed feed was melted down in the presence of atmospheric oxygen in a rotating smelting reactor, in the present case a rotating TBRC. For this purpose, the mixture in the smelting reactor was ignited by means of a burner and the pyrolytic reaction was started. The mixed feed had a calorific value of approximately 9800 kJ/kg.

The combustion reaction and thus the heat development could be specifically controlled by the amount of oxygen added. The volume flow of atmospheric oxygen was adjusted in such a manner that a reducing atmosphere always prevailed at the surface of the melt and a complete combustion of the organic fraction to CO2 and H2O did not take place; rather, specific contents of CO and H2 were present in the process gas. These were burned either in the upper part of the smelting reactor or outside the smelting reactor.

After a few minutes, at a temperature of approximately 1200-1300° C., a first melt with a first metallic phase and a first slag phase floating on the metallic phase was formed. This was then separated via a tapping opening arranged in the side wall of the smelting reactor in accordance with the second process step. The slag phase was analyzed and showed a copper content of 0.3-2.0 wt % and a viscosity of approximately 0.3 Pa*s.

The first metallic phase remaining in the smelting reactor, which had a copper content of approximately 97 wt %, was refined or converted, as the case may be, in the further process step by means of an oxygen-containing gas. For this purpose, oxygen-enriched air was injected into the metallic first phase via a lance, so that the oxygen affinity elements present in the metallic phase, such as lead (Pb), tin (Sn), nickel (Ni), iron (Fe), silicon (Si), titanium (Ti), sodium (Na), calcium (Ca), aluminum (Al), magnesium (Mg), etc., were oxidized from the metallic phase. If necessary, the process step can be assisted by the addition of slag-forming agents and thermally controlled by the addition of copper-containing residual materials as cooling scrap. This second slag phase formed also had a smaller density compared to the metallic phase. The process step of conversion was repeated twice, wherein the slag phase formed was superficially stripped off after each conversion step and analyzed with regard to composition. During the final conversion stage, a copper-enriched slag phase was formed, which had a copper content in the form of copper oxide ($Cu_2O$) of approximately 20 wt %.

Through another tap opening located in the bottom of the smelting reactor, the refined/converted first metallic phase was discharged from the smelting reactor, while the copper-enriched slag phase of the final conversion stage remained in the smelting reactor.

Then the process started with a new batch in accordance with step i) by adding a new mixed feed comprising the electronic waste to the copper-enriched slag phase and melting it down. The second mixed feed had the same composition as the first, although this is not absolutely necessary. The reducing conditions prevailing during melting down allowed the raw copper and heavy metal content of the slag phase to be recovered directly. Since re-smelting of the slag phase can be avoided in this manner, it was possible to save approximately 350 kWh of energy pert of slag remaining in the smelting reactor.

The invention claimed is:

1. A method for obtaining metals of the 8th to 14th groups, comprising the steps of:

i) providing and melting down a mixed feed comprising electronic waste in a smelting reactor, so that a first melt with a first metallic phase and a first slag phase is formed;

ii) removing the first slag phase from the smelting reactor;

iii) refining the first metallic phase that remains in the smelting reactor by an oxygen-containing gas, thereby forming a refined first metallic phase and a second, copper-enriched slag phase;

iv) removing the refined first metallic phase from the smelting reactor; and v) adding a further mixed feed comprising electronic waste to the second, copper-enriched slag phase that remains in the smelting reactor and repeating process steps i) to v).

2. The method according to claim 1, wherein the first slag phase is reduced by a reducing agent.

3. The method according to claim 1, wherein steps i) to v) are carried out at a temperature of at least 1150° C.

4. The method according to claim 1, wherein the mixed feed comprises the electronic waste in an amount of at least 10 wt %.

5. The method according to claim 1, wherein the mixed feed comprises a slag-forming agent and/or wherein a slag-forming agent is added to the process in steps i) and/or iii).

6. The method according to claim 5, wherein the mixed feed comprises the slag-forming agent in an amount of at least ⅛ of the mass fraction of the electronic waste present in the mixed feed.

7. The method according to claim 5, wherein the slag-forming agent is selected from the group consisting of iron, iron oxides, calcium oxide, calcium carbonate, calcium hydroxide, magnesium oxide, magnesium carbonate, magnesium hydroxide, sodium oxide, sodium carbonate, sodium hydroxide, silicon dioxide, silicon carbonate, and silicon hydroxide.

8. The method according to claim 1, wherein the electronic waste comprises an aluminum content of 0.1 to 20.0 wt %.

9. The method according to claim 1, wherein the electronic waste comprises an organic content of 5.0 to 80.0 wt %.

10. The method according to claim 1, wherein the electronic waste is crushed to a particle size smaller than 20 inches, and optionally provided in the form of pressed articles in accordance with step i).

11. The method according claim 1, wherein step i) is assisted by selectively injecting an oxygen-containing gas.

12. The method according to claim 1, wherein the metallic phase is removed via a tapping opening arranged in a bottom and/or in a side wall of the smelting reactor.

13. The method according to claim 1, further comprising:

introducing copper-containing residual materials into the smelting reactor while refining the first metallic phase, whereby a further slag phase is formed; and removing the further slag phase from the smelting reactor before removing the refined first metallic phase.

14. The method according to claim 1, wherein the copper-enriched slag phase remaining in the smelting reactor comprises copper oxide ($Cu_2O$).

15. The method according to claim 14, further comprising transferring the copper oxide ($Cu_2O$) remaining in the smelting reactor into the first metallic phase during a subsequent step i) as a result of prevailing reducing conditions in the smelting reactor.

16. A method for obtaining raw copper, comprising:

i) providing and melting down a mixed feed comprising electronic waste in a smelting reactor, so that a first melt with a first metallic phase and a first slag phase is formed;

ii) removing the first slag phase from the smelting reactor;

iii) refining a remaining first metallic phase by an oxygen-containing gas, thereby forming a refined first metallic phase and a second, copper-enriched slag phase;

iv) removing the refined first metallic phase from the smelting reactor; and v) introducing a further mixed feed comprising electronic waste to the second slag phase that remains in the smelting reactor and repeating process steps i) to v).

* * * * *